US005558279A

United States Patent [19]

Desrumaux

[11] Patent Number: 5,558,279

[45] Date of Patent: Sep. 24, 1996

[54] PROCESS AND PLANT FOR GRINDING SPENT POTLININGS AND SIMILAR MATERIALS

[75] Inventor: Francis Desrumaux, St. Romain En Gal, France

[73] Assignee: FCB, Montreuil, France

[21] Appl. No.: 446,588

[22] PCT Filed: Sep. 27, 1994

[86] PCT No.: PCT/FR94/01121

§ 371 Date: May 22, 1995

§ 102(e) Date: May 22, 1995

[87] PCT Pub. No.: WO95/09052

PCT Pub. Date: Apr. 6, 1995

[30] Foreign Application Priority Data

Sep. 28, 1993 [FR] France ..... 93 11492

[51] Int. Cl.[6] ..... B02C 9/04; B02C 23/08

[52] U.S. Cl. ..... 241/24.25; 241/29; 241/152.2

[58] Field of Search ..... 241/24, 29, 152.2, 241/268, 24.25

[56] References Cited

U.S. PATENT DOCUMENTS

| | | | |
|---|---|---|---|
| 3,326,479 | 6/1967 | Connolly et al. | 241/268 |
| 3,606,176 | 9/1971 | Vodic . | |
| 3,658,261 | 4/1972 | Limpinsel et al. | 241/25 |
| 4,113,832 | 9/1978 | Bell et al. . | |
| 4,765,546 | 8/1988 | Stewart | 241/36 |
| 4,889,289 | 12/1989 | Lohnherr et al. | 241/18 |
| 5,462,234 | 10/1995 | Patzelt et al. | 241/19 |
| 5,505,389 | 4/1996 | Süssegger et al. | 241/48 |

FOREIGN PATENT DOCUMENTS

| | | |
|---|---|---|
| 2056425 | 3/1981 | United Kingdom . |
| WO91/08836 | 6/1991 | WIPO . |

*Primary Examiner*—John M. Husar
*Attorney, Agent, or Firm*—Collard & Roe, P.C.

[57] ABSTRACT

The invention relates to aluminium smelters in which the treatment of spent potlinings (carbonaceous products resulting from the demolition of the lining of the walls and bottom of the electrolytic pots) requires a prior reduction of the potlinings into pieces not bigger than a few millimetres in size. The grinding process forming the subject of the invention is characterized in that it includes a crushing operation (12) in which the spent potlinings are reduced into pieces not bigger than 50 mm, a screening operation (16) permitting to separate those drains measuring a few millimetres and constituting the finished product, and a grinding operation (14) permitting to reduce the screen oversize to the finished product dimensions.

15 Claims, 3 Drawing Sheets

PROCESS AND PLANT FOR GRINDING SPENT POTLININGS AND SIMILAR MATERIALS

BACKGROUND OF THE INVENTION

1. Field of the Invention

Spent potlinings are carbonaceous products resulting from the demolition of the lining of the walls and bottom of the electrolytic pots which constitutes the cathode. This lining wears out and deteriorates and it is necessary to replace it periodically by a new lining. The lining-demolition operation, called unlining, is carried out by means of pneumatic tools and gives large-size lumps which may contain inclusions of metals such as iron and aluminium. Next, these lumps are reduced, by conventional means, to a size allowing them to go through a more or less 400 mm square-mesh grate.

2. Description of the Prior Art

Spent potlinings are strongly impregnated with noxious products, fluorides and cyanides for example. Up to now, they have been tipped in waste dumps, but the new regulations about pollution and environmental protection make it an obligation to treat them, e.g. to calcine them, in order to eliminate the noxious products and, possibly, to recover carbonaceous constituents.

The invention relates more particularly to the aluminium smelters in which the spent potlinings must be reduced into pieces not bigger than a few millimetres in size before being treated, and is concerned with a process and a grinding plant permitting to reach this result with only two size reduction stages and a screening operation.

SUMMARY OF THE INVENTION

The process forming the subject of this invention is characterized in that it includes a crushing operation in which the spent potlinings are reduced into pieces not bigger than 50 mm, a screening operation permitting to separate those grains measuring a few millimetres and constituting the finished product, and a grinding operation permitting to reduce the screen oversize to the finished product dimensions. Preferably, all the grains of the finished product shall be smaller than 2.5–3 mm. The products of the grinding operation may be recirculated to the screen.

The plant for embodying the invention is characterized in that it includes a crusher, a screen with an opening size corresponding to that of the finished product, a vibrating cone mill, means to convey the products discharged from the crusher, and possibly those discharged from the mill, to the screen and means to recirculate the screen oversize to the mill inlet.

The vibrating cone mill is a mill in which the cone or the bowl is set vibrating, and the other part, bowl or cone, of the mill is stationary or moving. Mills of this type are capable of high reduction ratio as compared with conventional cone mills the movements of which are controlled by an eccentric.

The crusher can be a jaw crusher whose jaws form with each other an angle below 20°. This reduced angle improves the ability to grip products reputed to be soapy as spent potlinings are.

A peripheral discharge autogenous or semi-autogenous mill can be substituted for the jaw crusher.

BRIEF DESCRIPTION OF THE DRAWINGS

Other features of the invention will be brought to the fore by the following description which refers to the drawings appended thereto which show, as a non-limiting example, two embodiments of the invention. In which.

DESCRIPTION OF THE PREFERRED EMBODIMENTS

Figure 1:
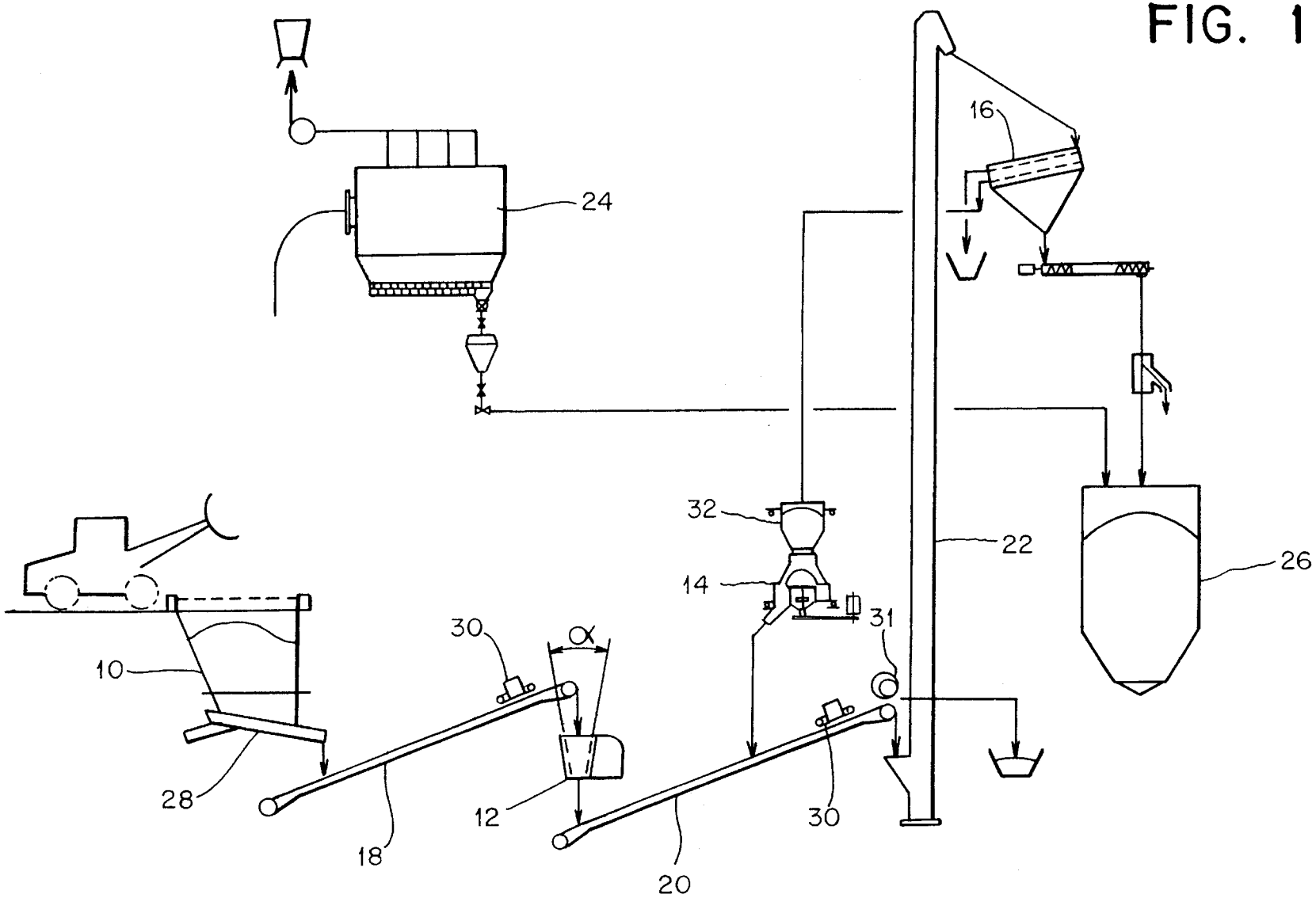
FIG. 1 is a diagram of a spent potlining grinding plant designed according to the invention.

The plant shown in FIG. 1 consists basically of a feed hopper 10, a jaw crusher 12, a vibrating cone mill 14, a screen 16, two endless belt conveyors 18 and 20, an elevator 22, a dust collecting filter 24 and a silo 26.

Hopper 10 is provided with a vibrating feeder 28 permitting to load the lumps contained in the same onto conveyor 18 which feeds crusher 12. Magnetic separators 30 and eddy-current separators 31, which permit to eliminate the iron scraps and other metal pieces, are mounted on conveyors 18 and 20 and/or at their discharge point.

Crusher 12 is a single toggle jaw crusher. It is a conventional-design unit except as regards the $\alpha$ angle formed by the jaws, which is equal to about 16° and distinctly smaller than the usual angle in this type of crusher. This reduced angle favours the grip on products reputed to be soapy as spent potlinings are.

The feed opening of crusher 12 is sufficient to receive lumps passing through a 400 mm square mesh grate and its discharge opening is so sized that the lumps are reduced into pieces the great majority of which are smaller than 50 mm or so.

This result, which corresponds to a reduction ratio in the order of 8, is reached not only owing to an appropriate sizing of the feed and discharge openings, but also owing to the adoption of a reduced stroke of the swing jaw so that the capacity of the crusher be distinctly smaller than that of a conventional cone crusher of the same size, e.g. 10 tph instead of 50–60 tph.

The crushed product is loaded on conveyor 20 and carried by the latter and elevator 22 up to screen 16. This is equipped with a grate with openings a few millimetres square, 3 mm for example. The products which pass through this grate are stored in silo 26.

Screen 16 is also equipped with an upper 50 mm-opening grate which permits to recover and eliminate ungrindable pieces, if any, mainly pieces of aluminium, which would have been squashed and discharged by cone mill 14.

Screen 16 oversize, which is coarser than 3 mm, is sent into a buffer bin 32 which feeds cone mill 14 and permits to maintain it permanently under load, which is an essential requirement for its efficiency.

Figure 2:
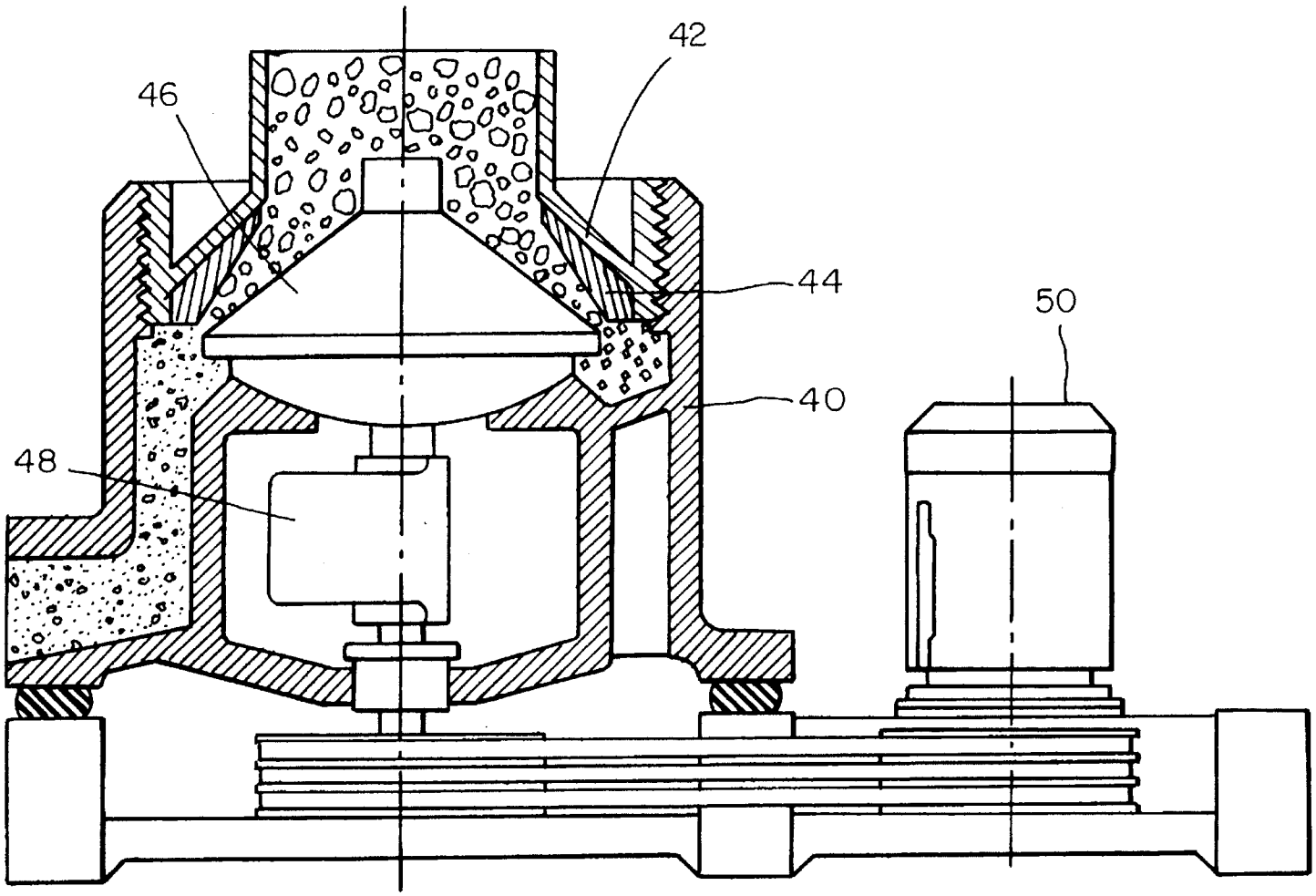
FIG. 2 is a vertical section of a vibrating cone mill.

As conventional cone mills, cone mill 14, shown on FIG. 2, consists of a frame 40 the top part of which bears a bowl 42 in which a hollow truncated-cone shaped wear part 44, called concave, is fixed, and of a cone 46 placed inside the concave and resting on a spherical surface the centre of which is situated on the concave centre line and which allows the cone to rotate about its axis and to move in a gyratory way inside the concave. While the motions of the cone are controlled by an eccentric in conventional cone mills, in mill 14 these motions are caused by an offset mass 48 mounted rotatively on the cone shaft and rotated by a motor 50. This mill has a reduction ratio in the order of 20, markedly higher than that of a conventional cone mill.

The products coming out of mill 14 are loaded on conveyor 20 and carried to screen 16, together with the products discharged by the crusher.

Though, in the described example, that part rotated by a rotary offset mass is the mill cone, the denomination vibrating cone mill used in this description includes any cone mills in which one of the elements, cone or bowl, or both are set vibrating by any adequate means which does not force the said element to follow a predetermined path.

The jaw crusher could be replaced by other units capable of reducing 400 mm lumps into pieces of 50 mm or less in size. In particular, a peripheral discharge autogenous or semi-autogenous mill could be used. This machine, which consists of a horizontal axis drum the diameter of which is larger than the length and which is rotated about its axis, by suitable means, is fed through a central opening provided in one of its heads and includes a wall provided, near the other head, with openings the dimensions of which are determined so that only those pieces smaller than the maximum desired size may pass through.

Figure 3:
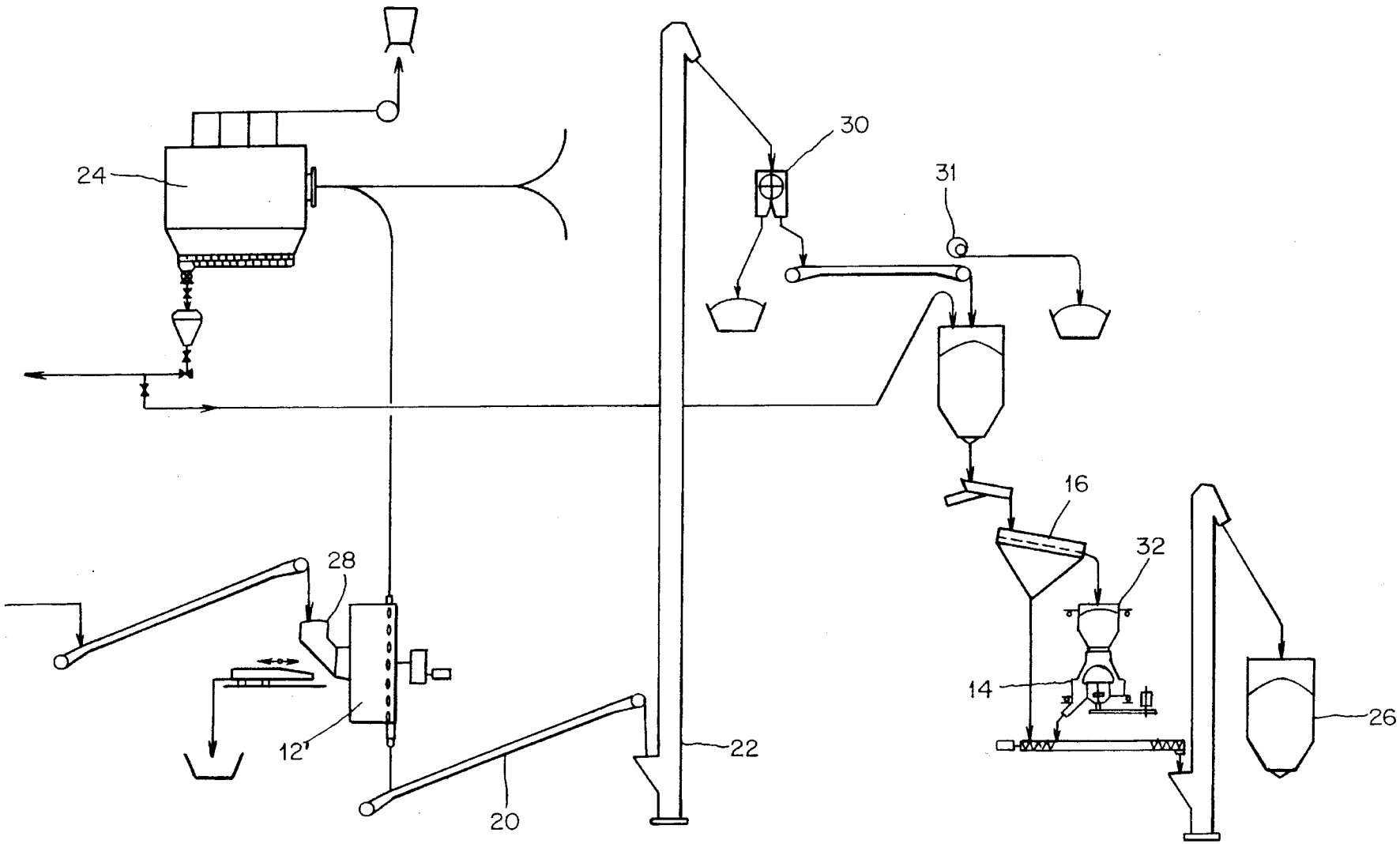
FIG. 3 is the diagram of another plant in conformity with the invention.

FIG. 3 shows the diagram of a plant including an autogenous mill identified by reference number 12'. All the other units of this plant are identified by the same reference number as on FIG. 1. In the plant represented, one of the heads of mill 12' has a central opening into which a feed duct 28 opens, and the cylindrical wall of the mill is provided, near the other head, with ground product discharge openings. These openings are surrounded with a ring-shaped casing the base of which is provided with a lock chamber for the discharge of the ground products, and which is connected to the inlet of a fan through filter 24. The fine fraction of the ground product is removed by the air stream flowing through the mill and recovered in the filter. As an alternative, The fine ground products could be removed pneumatically through a central opening in the mill head adjacent to the peripheral openings.

Autogenous mill 12' reduces the 400 mm lumps into pieces the size of which is in the order of 30 mm and vibrating cone mill 14 works in open circuit (without screening of the ground products and recycling of the oversize), since nearly all the ground products are smaller than 3 mm.

Of course it is understood that any modifications which may be made in the above described embodiments by using equivalent technical means fall within the scope of the invention.

Furthermore, the invention is not limited to the grinding of spent potlinings but it applies also to similar materials, polluted by metals and/or noxious products, such as cyanides, fluorides, etc . . . , for example to the bricklinings or refractory linings of steel high furnaces or metal melting furnaces.

I claim:

1. A method for comminuting spent potlinings comprising the steps of:

(a) crushing the spent potlinings to reduce them into pieces the majority of which are smaller in size than 50 mm, (b) screening the crushed pieces to separate grains smaller in size than 2.5–3 mm, and (c) grinding the screened pieces larger in size than 2.5–3 mm in a vibrating cone mill, so as to reduce them to grains most of which are smaller in size than 2.5–3 mm.

2. The method according to claim 1, wherein the ground pieces are mixed with the crushed pieces before the screening step.

3. The method according to claim 1, wherein the reduction ratio of the vibrating cone mill is about 20.

4. The method according to claim 1, wherein the crushing step is carried out in a jaw crusher the jaws of which form with each other an angle smaller than 20°.

5. The method according to claim 4, wherein the crushing step is carried out in a jaw crusher the jaws of which form with each other an angle which is equal to about 16°.

6. The method according to claim 1, wherein the crushing step is carried out in an autogenous mill.

7. The method according to claim 1, wherein the crushing step is carried out in a semi-autogenous mill.

8. A plant for comminuting spent potlinings, comprising:

(a) a crusher, (b) a screening device having a first outlet for undersized products and a second outlet for oversized products, (c) means for conveying the crushed products from the crusher to the screening device, (d) a vibrating cone mill, and (e) means for conveying the oversized products from the second outlet of the screening device to the vibrating cone mill for grinding.

9. A plant according to claim 8, wherein the crusher is a jaw crusher the jaws of which form with each other an angle smaller than 20°.

10. A plant according to claim 9, wherein the crusher is a jaw crusher the jaws of which form with each other an angle which is equal to about 16°.

11. A plant according to claim 8, wherein the crusher is an autogenous mill with peripheral discharge openings.

12. A plant according to claim 8, wherein the crusher is a semi-autogenous mill with peripheral discharge openings.

13. A plant according to claim 8, including a bin which feeds the mill and maintains it permanently under load.

14. A plant according to claim 8, including further means for conveying the ground products from the mill to the screening device.

15. A plant according to claim 8, wherein the vibrating cone mill comprises two cooperating elements, namely: a bowl and a cone located inside the bowl, and means for imparting vibrations to at least one of said elements.

* * * * *